US011198957B2

(12) United States Patent
Sato et al.

(10) Patent No.: US 11,198,957 B2
(45) Date of Patent: Dec. 14, 2021

(54) FABRIC FOR ELECTRIC-ARC PROTECTIVE CLOTHING, AND ELECTRIC-ARC PROTECTIVE CLOTHING

(71) Applicant: Kaneka Corporation, Osaka (JP)

(72) Inventors: Motohiro Sato, Hyogo (JP); Yoshitomo Matsumoto, Hyogo (JP); Tatsuro Ohzeki, Hyogo (JP); Wataru Mio, Hyogo (JP); Yasunori Tanaka, Ishikawa (JP); Yuto Utsunomiya, Ishikawa (JP); Tomoya Matsushima, Ishikawa (JP)

(73) Assignee: KANEKA CORPORATION, Osaka (JP)

( * ) Notice: Subject to any disclaimer, the term of this patent is extended or adjusted under 35 U.S.C. 154(b) by 167 days.

(21) Appl. No.: 16/117,906

(22) Filed: Aug. 30, 2018

(65) Prior Publication Data

US 2018/0371647 A1 Dec. 27, 2018

Related U.S. Application Data

(63) Continuation of application No. PCT/JP2017/006888, filed on Feb. 23, 2017.

(30) Foreign Application Priority Data

Mar. 4, 2016 (JP) ..... JP2016-042571

(51) Int. Cl.
*D02G 3/44* (2006.01)
*D01F 6/54* (2006.01)
(Continued)

(52) U.S. Cl.
CPC ..... *D02G 3/443* (2013.01); *A41D 31/26* (2019.02); *D01F 1/106* (2013.01); *D01F 6/40* (2013.01);
(Continued)

(58) Field of Classification Search
CPC ..... A41D 13/008; A41D 31/26; D01F 1/106; D01F 6/40; D01F 6/54; D02G 3/047;
(Continued)

(56) References Cited

U.S. PATENT DOCUMENTS 3,313,768 A * 4/1967 Veazey ..... C08L 33/20 524/321
3,873,508 A * 3/1975 Turner ..... D01F 6/18 526/86
(Continued)

FOREIGN PATENT DOCUMENTS

CN 102409422 A 4/2012
CN 103261500 A 8/2013
(Continued)

OTHER PUBLICATIONS https://patents.google.com/patent/CN103436974B/en?oq=16117906 (Year: 2013).*
(Continued)

*Primary Examiner* — Arti Singh-Pandey
(74) *Attorney, Agent, or Firm* — Osha Bergman Watanabe & Burton LLP

(57) ABSTRACT

A fabric for arc-protective garments includes first yarns and second yarns different from the first yarns. The first yarns include first modacrylic fibers, and the first modacrylic fibers contain an infrared absorber in an amount of 2.5 wt % or more with respect to a total weight of the first modacrylic fibers. The weight of the infrared absorber per unit area in the fabric for arc-protective garments is 0.05 oz/yd$^2$ or more. An arc-protective garment includes the fabric for arc-protective garments.

19 Claims, 2 Drawing Sheets

(51) Int. Cl.

| | |
|---|---|
| ***D03D 15/00*** | (2021.01) |
| ***D01F 1/10*** | (2006.01) |
| ***D01F 6/40*** | (2006.01) |
| ***A41D 31/26*** | (2019.01) |
| ***D03D 15/513*** | (2021.01) |
| ***D02G 3/04*** | (2006.01) |

(52) U.S. Cl.
CPC ..... *D01F 6/54* (2013.01); *D02G 3/047* (2013.01); *D03D 15/00* (2013.01); *D03D 15/513* (2021.01); *D10B 2321/101* (2013.01); *D10B 2331/021* (2013.01)

(58) Field of Classification Search
CPC ..... D02G 3/443; D03D 15/00; D03D 15/12; D03D 1/0076; D10B 2321/101; D10B 2331/021
See application file for complete search history.

(56) References Cited

U.S. PATENT DOCUMENTS

| | | | | |
|---|---|---|---|---|
| 2003/0154564 | A1* | 8/2003 | Nakashima | D06P 1/90 8/405 |
| 2003/0203688 | A1 | 10/2003 | Campbell et al. | |
| 2005/0025963 | A1 | 2/2005 | Zhu | |
| 2005/0208855 | A1 | 9/2005 | Zhu | |
| 2006/0292953 | A1 | 12/2006 | Ashley et al. | |
| 2009/0053957 | A1* | 2/2009 | Zhu | D02G 3/443 442/302 |
| 2010/0299817 | A1 | 12/2010 | Zhu | |
| 2013/0055490 | A1 | 3/2013 | Zhu | |
| 2013/0216810 | A1 | 8/2013 | Hines et al. | |
| 2013/0247287 | A1* | 9/2013 | Mizobuchi | A41D 31/26 2/455 |
| 2014/0283290 | A1* | 9/2014 | Mizobuchi | D02G 3/04 2/458 |
| 2016/0201236 | A1* | 7/2016 | Matsumoto | D01F 6/40 2/243.1 |
| 2017/0295875 | A1* | 10/2017 | Ohzeki | D03D 1/00 |

FOREIGN PATENT DOCUMENTS

| | | | |
|---|---|---|---|
| CN | 103436974 | A | 12/2013 |
| CN | 104762711 | A | 7/2015 |
| EP | 3243940 | A1 | 11/2017 |
| JP | H08158202 | A | 6/1996 |
| JP | H09-275824 | A | 10/1997 |
| JP | 2007-500802 | A | 1/2007 |
| JP | 2007-529649 | A | 10/2007 |
| JP | 2012-528954 | A | 11/2012 |
| JP | 2013-533394 | A | 8/2013 |
| JP | 2014-525520 | A | 9/2014 |
| WO | 2005/033382 | A2 | 4/2005 |
| WO | 2005090660 | A1 | 9/2005 |
| WO | 2010141554 | A1 | 12/2010 |
| WO | 2012/016124 | A2 | 2/2012 |
| WO | 2013/032563 | A1 | 3/2013 |
| WO | 2015/171990 | A1 | 11/2015 |
| WO | 2016/111116 | A1 | 7/2016 |

OTHER PUBLICATIONS

International Search Report issued in Application No. PCT/JP2017/006888, dated May 16, 2017 (2 pages).
Written Opinion issued in Application No. PCT/JP2017/006888, dated May 16, 2017 (4 pages).
Office Action issued in corresponding Chinese Application No. 201780014558.7; dated Jul. 4, 2019 (10 pages).
Extended European Search Report issued in European Application No. 17759807.5, dated Jan. 8, 2020 (8 pages).

* cited by examiner

FABRIC FOR ELECTRIC-ARC PROTECTIVE CLOTHING, AND ELECTRIC-ARC PROTECTIVE CLOTHING

TECHNICAL FIELD

One or more embodiments of the present invention relate to a fabric for arc-protective garments and an arc-protective garment with arc resistance.

BACKGROUND

In recent years, a large number of arc flash accidents have been reported. In order to reduce the risk of arc flash, it has been studied to impart arc resistance to protective garments to be worn by workers such as electric mechanics and factory workers who work in an environment that involves the risk of actually being exposed to an electric arc.

For example, Patent Documents 1 and 2 disclose protective garments made of arc-protective yarns or fabrics including modacrylic fibers and aramid fibers. Patent Document 3 discloses the use of yarns or fabrics including antimony-containing modacrylic fibers or flame-retardant acrylic fibers and aramid fibers in arc-protective garments.

PATENT DOCUMENTS

Patent Document 1: JP 2007-529649 A

Patent Document 2: JP 2012-528954 A Patent Document 3: US 2006/0292953 A1

In Patent Documents 1 and 3, arc resistance is imparted to yarns or fabrics by adjusting the blending amounts of modacrylic fibers and aramid fibers, but arc resistance is low when the basis weight is low. In Patent Document 2, arc resistance is imparted by blending modacrylic fibers having a limited antimony content and aramid fibers, but arc resistance is low when the basis weight is low.

SUMMARY

One or more embodiments of the present invention provide a fabric for arc-protective garments and an arc-protective garment that include modacrylic fibers and that can exhibit high arc resistance even when the basis weight is low.

One or more embodiments of the present invention relate to a fabric for arc-protective garments including first yarns and second yarns different from the first yarns. The first yarns include first modacrylic fibers, and the first modacrylic fibers contain an infrared absorber in an amount of 2.5% by weight or more inside the fibers with respect to a total weight of the fibers. The weight of the infrared absorber per unit area in the fabric for arc-protective garments is 0.05 oz/yd$^2$ or more.

In one or more embodiments of the present invention, it is preferred that the fabric for arc-protective garments is a woven fabric in which the first yarns and the second yarns are woven together.

In one or more embodiments of the present invention, it is preferred that an exposure amount of the first yarns in a first surface of the fabric for arc-protective garments differs from an exposure amount of the first yarns in a second surface of the fabric for arc-protective garments located opposite to the first surface.

In one or more embodiments of the present invention, it is preferred that the first yarns include the first modacrylic fibers in an amount of 30% by weight or more with respect to a total weight of the first yarns.

In one or more embodiments of the present invention, it is preferred that the first modacrylic fibers contain an antimony compound.

In one or more embodiments of the present invention, it is preferred that the second yarns include modacrylic fibers and/or fibers having a standard moisture regain of 8% or more. In one or more embodiments of the present invention, it is preferred that the second yarns include second modacrylic fibers containing a heat absorbing material and/or a light reflecting material. The heat absorbing material may be an aluminium hydroxide. The light reflecting material may be a titanium oxide.

In one or more embodiments, it is preferred that when the fabric for arc-protective garments has a basis weight of 6.5 oz/yd$^2$ or less, an ATPV (Arc Thermal Performance Value) thereof measured based on ASTM F1959/F1959M-12 (Standard Test Method for Determining the Arc Rating of Materials for Clothing) is 8 cal/cm$^2$ or more.

One or more embodiments of the present invention further relate to an arc-protective garment including the above-described fabric for arc-protective garments.

One or more embodiments of the present invention provide a fabric for arc-protective garments and an arc-protective garment that include modacrylic fibers and that can exhibit high arc resistance even when the basis weight is low.

DETAILED DESCRIPTION OF THE EMBODIMENTS

Figure 1A:
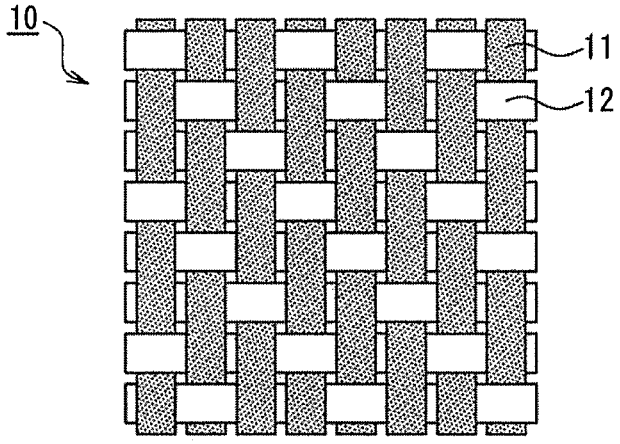
FIG. 1A is a weave diagram of a fabric for arc-protective garments (woven fabric) of one or more embodiments of the present invention.

The present inventors repeatedly examined ways to increase arc resistance of low basis weight fabrics including modacrylic fibers. As a result, the present inventors found that fabrics constituted by modacrylic fibers containing 2.5 wt % or more of an infrared absorber can increase an ATPV (Arc Thermal Performance Value) by absorbing infrared rays as compared with fabrics constituted by modacrylic fibers that do not contain an infrared absorber, thereby improving arc resistances. Fabrics with a high basis weight (e.g., above 7 oz/yd$^2$) can increase an ATPV (Arc Thermal Performance Value) by increasing the blending amount of an infrared absorber, but fabrics with a low basis weight (e.g., 6.5 oz/yd$^2$ or less) are difficult to obtain an effect of further improving an ATPV (Arc Thermal Performance Value) just by increasing the blending amount of an infrared absorber unlike fabrics with a high basis weight because heat converted from absorbed infrared rays is easily conducted to the surface of the fabrics opposite to the irradiated surface. To cope with this, by constituting fabrics with first yarns and second yarns different from the first yarns, using yarns including first modacrylic fibers that contain 2.5 wt % or more of an infrared absorber inside the fibers with respect to the total weight of the fibers, as the first yarns, and setting the weight of the infrared absorber per unit area of the fabric to be 0.05 oz/yd$^2$ or more, the fabrics can improve arc resistance even when the basis weight is low.

In one or more embodiments, the first yarns may include first modacrylic fibers that contain an infrared absorber inside the fibers. An infrared absorber present inside fibers imparts better texture and higher washing resistance to fabrics than an infrared absorber adhered to fiber surfaces.

In one or more embodiments, the first modacrylic fibers may contain 2.5 wt % or more of an infrared absorber with respect to the total weight of the first modacrylic fibers, and thus having high arc resistance. The first modacrylic fibers may contain an infrared absorber in an amount of preferably 3 wt % or more, more preferably 4 wt % or more, and further preferably 5 wt % or more with respect to the total weight of the first modacrylic fibers, from the viewpoint of improving arc resistance. The first modacrylic fibers may contain an infrared absorber in an amount of preferably 30 wt % or less, more preferably 28 wt % or less, and further preferably 25 wt % or less with respect to the total weight of the first modacrylic fibers from the viewpoint of texture.

Any infrared absorber that has an effect of absorbing infrared rays can be used as the infrared absorber. For example, in one or more embodiments, it is preferred that the infrared absorber has an absorption peak in a wavelength range of 750 to 2500 nm. Specific examples of the infrared absorber include: tin oxide-based compounds such as antimony-doped tin oxide, indium tin oxide, niobium-doped tin oxide, phosphorus-doped tin oxide, fluorine-doped tin oxide, and antimony-doped tin oxide coating on titanium oxide; titanium oxide-based compounds such as iron-doped titanium oxide, carbon-doped titanium oxide, fluorine-doped titanium oxide, and nitrogen-doped titanium oxide; and zinc oxide-based compounds such as aluminum-doped zinc oxide, and antimony-doped zinc oxide. The indium tin oxide includes an indium-doped tin oxide and tin-doped indium oxide. From the viewpoint of improving arc resistance, the infrared absorber may be preferably a tin oxide-based compound, more preferably one or more selected from the group consisting of antimony-doped tin oxide, indium tin oxide, niobium-doped tin oxide, phosphorus-doped tin oxide, fluorine-doped tin oxide, and antimony-doped tin oxide coating on titanium oxide, further preferably one or more selected from the group consisting of antimony-doped tin oxide and antimony-doped tin oxide coating on titanium oxide, and still further preferably antimony-doped tin oxide coating on titanium oxide. Moreover, the use of the infrared absorber may be preferred to increase arc resistance and produce light-colored modacrylic fibers. The infrared absorber may be used individually or in combination of two or more.

In one or more embodiments, the average particle diameter of the infrared absorber is preferably 2 μm or less, more preferably 1 μm or less, and further preferably 0.5 μm or less, from the viewpoint of dispersibility into a modacrylic polymer constituting the modacrylic fibers. In one or more embodiments of the present invention, the average particle diameter of the infrared absorber in a powder form can be measured using a laser diffraction method, and the average particle diameter of the infrared absorber in a dispersion form (dispersion liquid) obtained by dispersing the infrared absorber in water or an organic solvent can be measured using a laser diffraction method or a dynamic light scattering method.

In one or more embodiments, the first modacrylic fibers may contain an antimony compound. The content of the antimony compound in the first modacrylic fibers may be preferably 1.6 to 33 wt %, and more preferably 3.8 to 21 wt % with respect to the total weight of the first modacrylic fibers. When the content of the antimony compound in the first modacrylic fibers is within the above range, the production stability in a spinning process is excellent, and favorable flame retardance is obtained.

Examples of the antimony compound include antimony trioxide, antimony tetroxide, antimony pentoxide, antimonic acid, antimonic acid salts such as sodium antimonate, and antimony oxychloride. These compounds can be used individually or in combination of two or more. The antimony compound may be preferably one or more compounds selected from the group consisting of antimony trioxide, antimony tetroxide, and antimony pentoxide, from the viewpoint of the production stability of a spinning process.

In one or more embodiments, the first yarns may include the first modacrylic fibers in an amount of preferably 30 wt % or more, more preferably 35 wt % or more, and further preferably 40 wt % or more with respect to the total weight of the first yarns, from the viewpoint of improving arc resistance. The upper limit of the content of the first modacrylic fibers in the first yarns is not particularly limited, but may be preferably 65 wt % or less, more preferably 60 wt % or less, and further preferably 55 wt % or less, from the viewpoint of imparting flame retardance.

In one or more embodiments, the first yarns may include aramid fibers from the viewpoint of improving the durability of the fabric for arc-protective garments. The first yarns may include the aramid fibers in an amount of 5 to 40 wt %, 5 to 35 wt %, 5 to 30 wt %, or 10 to 20 wt % with respect to the total weight of the first yarns.

In one or more embodiments, the first yarns may include cellulosic fibers from the viewpoint of obtaining a favorable texture of the fabric for arc-protective garments and improving the durability. The first yarns may include the cellulosic fibers in an amount of 30 to 65 wt %, 35 to 60 wt %, 35 to 50 wt %, or 35 to 40 wt % with respect to the total weight of the first yarns.

In one or more embodiments, the first yarns may include 30 to 65 wt % of the first modacrylic fibers, 5 to 40 wt % of the aramid fibers, and 30 to 65 wt % of the cellulosic fibers, or 35 to 65 wt % of the first modacrylic fibers, 5 to 40 wt % of the aramid fibers, and 35 to 60 wt % of the cellulosic fibers with respect to the total weight of the first yarns, from the viewpoint of arc resistance, durability and texture.

In one or more embodiments, the first yarns may include modacrylic fibers other than the first modacrylic fibers. Examples of the modacrylic fibers other than the first modacrylic fibers include modacrylic fibers containing an antimony compound such as an antimony oxide, and modacrylic fibers not containing an antimony compound.

Any yarns that are different from the first yarns may be used as the second yarns. In one or more embodiments, the second yarns include modacrylic fibers and/or fibers having a standard moisture regain of 8% or more (hereinafter, also referred to as "high-moisture fibers") from the viewpoint of arc resistance. The first modacrylic fibers may be used as the modacrylic fibers of the second yarns. In this case, it is necessary for the first yarns to have a higher first modacrylic fiber content than the second yarns. The first yarns may have a higher first modacrylic fiber content than the second yarns preferably by 5 wt % or more, and more preferably by 10 wt % or more. The second yarns may include modacrylic fibers other than the first modacrylic fibers. In one or more embodiments, the second yarns include second modacrylic fibers containing a heat absorbing material and/or a light reflecting material, from the viewpoint of improving arc resistance. The heat absorbing material can absorb heat generated from infrared rays that have been absorbed by the first modacrylic fibers in the first yarns. The light reflecting material can reflect infrared rays that have been absorbed by the first modacrylic fibers, to the outside of the fabric. In one or more embodiments, the heat absorbing material and/or the light reflecting material are present inside the fibers to improve texture and washing resistance.

Any material that can absorb heat can be used as the heat absorbing material. Examples of the heat absorbing material include aluminum fluoride, aluminium hydroxide, dicalcium phosphate, calcium oxalate, cobalt hydroxide, magnesium hydroxide, sodium hydrogencarbonate, and cobalt chloride ammonia complex. The aluminium hydroxide may be a natural mineral such as boehmite, gibbsite, diaspore, etc. The above heat absorbing materials may be used individually or in combination of two or more.

Any material that can reflect visible light or infrared rays can be used as the light reflecting material. Examples of the light reflecting material include titanium oxide, boron nitride, zinc oxide, silicon oxide, and aluminum oxide. The light reflecting materials may be used individually or in combination of two or more.

In one or more embodiments, the second modacrylic fibers may contain the heat absorbing material and/or the light reflecting material inside the fibers in an amount of preferably 1 to 10 wt %, more preferably 1 to 7 wt %, and further preferably 1 to 5 wt % with respect to the total weight of the second modacrylic fibers, from the viewpoint of arc resistance and texture.

In one or more embodiments, the average particle diameters of the heat absorbing material and the light reflecting material are preferably 2 μm or less, more preferably 1 μm or less, and further preferably 0.5 μm or less, from the viewpoint of dispersibility into a modacrylic polymer constituting the modacrylic fibers. In one or more embodiments of the present invention, the average particle diameters of the heat absorbing material and the light reflecting material in a powder form can be measured using a laser diffraction method, and the average particle diameters thereof in a dispersion form (dispersion liquid) obtained by dispersing the heat absorbing material or the light reflecting material in water or an organic solvent can be measured using a laser diffraction method or a dynamic light scattering method.

In one or more embodiments, the second modacrylic fibers may contain an antimony compound. The content of the antimony compound in the second modacrylic fibers may be preferably 1.6 to 33 wt %, and more preferably 3.8 to 21 wt % with respect to the total weight of the second modacrylic fibers. When the content of the antimony compound in the second modacrylic fibers is within the above range, the production stability in a spinning process is excellent, and favorable flame retardance is obtained. The same antimony compounds as those to be contained in the first modacrylic fibers described above can be used as the antimony compounds of the second modacrylic fibers.

In one or more embodiments of the present invention, the standard moisture regain of fibers is based on JIS L 0105 (2006). The values indicated in JIS L 0105 (2006), 4.1, Table 1 "Standard Moisture Regains of Fibers" can be used as the standard moisture regains of various fibers. There is no particular limitation on the standard moisture regain of the high-moisture fibers, but it may be preferably 8% or more, and from the viewpoint of further improving arc resistance, it may be more preferably 10% or more, and further preferably 11% or more. The upper limit of the standard moisture regain of the high-moisture fibers is not particularly limited, but may be 20% or less from the viewpoint of availability.

The high-moisture fibers may be, e.g., cellulosic fibers and natural animal fibers. The cellulosic fibers may be natural cellulosic fibers or regenerated cellulosic fibers. Examples of the natural cellulosic fibers include cotton, kabok, linen, ramie, and jute. Examples of the regenerated cellulosic fibers include rayon, polynosic, cupra, and lyocell. Examples of the natural animal fibers include wool, camel, cashmere, mohair, other animal hair, and silk. The fiber length of the cellulosic fibers may be preferably 15 to 38 mm, and more preferably 20 to 38 mm from the viewpoint of strength. The fineness of the regenerated cellulosic fibers may be preferably, though not particularly limited to, 1 to 20 dtex, and more preferably 1.2 to 15 dtex. The high-moisture fibers may be used individually or in combination of two or more.

It is considered that, by blending the fibers having a standard moisture regain of 8% or more in the second yarns, it is possible to reduce heat generation of the first modacrylic fibers in the first yarns due to absorption of infrared rays, thereby improving arc resistance of the fabric.

In one or more embodiments, the second yarns may include the modacrylic fibers in an amount of 30 wt % or more, 35 wt % or more, or 40 wt % or more with respect to the total weight of the second yarns. The upper limit of the content of the modacrylic fibers in the second yarns is not particularly limited, but may be 65 wt % or less, 60 wt % or less, or 55 wt % or less. The second yarns may include the second modacrylic fibers in an amount of preferably 30 wt % or more, more preferably 35 wt % or more, and further preferably 40 wt % or more with respect to the total weight of the second yarns, from the viewpoint of improving arc resistance. The upper limit of the content of the second modacrylic fibers in the second yarns is not particularly limited, but may be preferably 65 wt % or less, more preferably 60 wt % or less, and further preferably 55 wt % or less, from the viewpoint of imparting flame retardance.

In one or more embodiments, the second yarns may include the high-moisture fibers in an amount of 30 wt % or more, 35 wt % or more, or 40 wt % or more with respect to the total weight of the second yarns from the viewpoint of improving arc resistance. The upper limit of the content of the high-moisture fibers in the second yarns is not particularly limited, but may be 95 wt % or less. The high-moisture fibers included in the second yarns can impart a favorable texture and improved durability to the fabric for arc-protective garments. When the first yarns and the second yarns both include the cellulosic fibers, the second yams may have a higher cellulosic fiber content than the first yarns by 30 wt % or more, and more preferably by 50 wt % or more.

In one or more embodiments, the second yarns may include aramid fibers from the viewpoint of improving the durability of the fabric for arc-protective garments. The second yarns may include the aramid fibers in an amount of 5 to 40 wt %, 5 to 35 wt %, 5 to 30 wt %, or 10 to 20 wt % with respect to the total weight of the second yarns.

In one or more embodiments, the second yarns may include 30 to 65 wt % of the modacrylic fibers, 5 to 40 wt % of the aramid fibers, and 30 to 65 wt % of the cellulosic fibers, or 35 to 65 wt % of the modacrylic fibers other than the first modacrylic fibers, 5 to 40 wt % of the aramid fibers, and 35 to 60 wt % of the cellulosic fibers with respect to the total weight of the second yarns, from the viewpoint of arc resistance, durability and texture. The second yarns may include 30 to 65 wt % of the second modacrylic fibers, 5 to 40 wt % of the aramid fibers, and 30 to 65 wt % of the cellulosic fibers, or 35 to 65 wt % of the second modacrylic fibers, 5 to 40 wt % of the aramid fibers, and 35 to 60 wt % of the cellulosic fibers with respect to the total weight of the second yarns, from the viewpoint of improving arc resistance.

In one or more embodiments, the second yarns may include 60 to 95 wt % of the high-moisture fibers and 5 to 40 wt % of the aramid fibers, or 65 to 90 wt % of the high-moisture fibers and 10 to 35 wt % of the aramid fibers with respect to the total weight of the second yarns, from the viewpoint of arc resistance, durability and texture.

In one or more embodiments, it is preferred that the first modacrylic fibers, the second modacrylic fibers and the other modacrylic fibers are made from a modacrylic polymer including 40 to 70 wt % of acrylonitrile and 30 to 60 wt % of other components with respect to the total weight of the modacrylic polymer. When the content of acrylonitrile in the modacrylic polymer is 40 to 70 wt %, modacrylic fibers produced thereby can have favorable thermal resistance and flame retardance.

There is no particular limitation on the other components as long as they are copolymerizable with acrylonitrile. Examples thereof include halogen-containing vinyl-based monomers and sulfonic acid group-containing monomers.

Examples of the halogen-containing vinyl-based monomers include halogen-containing vinyl and halogen-containing vinylidene. Examples of the halogen-containing vinyl include vinyl chloride and vinyl bromide, and examples of the halogen-containing vinylidene include vinylidene chloride and vinylidene bromide. These halogen-containing vinyl-based monomers may be used individually or in combination of two or more. In one or more embodiments, it is preferred that the arc resistant modacrylic fibers contain the halogen-containing vinyl-based monomer as the other component in an amount of 30 to 60 wt % with respect to the total weight of the modacrylic polymer from the viewpoint of thermal resistance and flame retardance.

Examples of the sulfonic acid group-containing monomers include methacrylicsulfonic acid, allylsulfonic acid, styrenesulfonic acid, 2-acrylamide-2-methylpropanesulfonic acid, and salts thereof. Examples of the salts include, though not particularly limited to, sodium salts such as sodium p-styrenesulfonate, potassium salts, and ammonium salts. These sulfonic acid group-containing monomers may be used individually or in combination of two or more.

The sulfonic acid group-containing monomer is used as needed. When the content of the sulfonic acid group-containing monomer in the modacrylic polymer is 3 wt % or less, the production stability of a spinning process is excellent.

In one or more embodiments, it is preferred that the modacrylic polymer is a copolymer obtained by copolymerizing 40 to 70 wt % of acrylonitrile, 30 to 57 wt % of the halogen-containing vinyl-based monomer, and 0 to 3 wt % of the sulfonic acid group-containing monomer. In one or more embodiments, it is more preferred that the modacrylic polymer is a copolymer obtained by copolymerizing 45 to 65 wt % of acrylonitrile, 35 to 52 wt % of the halogen-containing vinyl-based monomer, and 0 to 3 wt % of the sulfonic acid group-containing monomer.

There is no particular limitation on the finenesses of the first modacrylic fibers, the second modacrylic fibers and the other modacrylic fibers, but the finenesses thereof may be preferably 1 to 20 dtex, and more preferably 1.5 to 15 dtex, from the viewpoint of spinnability and processability during production the fabric and texture and strength of the produced fabric. Also, there is no particular limitation on the fiber lengths of the above modacrylic fibers, but the fiber lengths thereof may be preferably 38 to 127 mm, and more preferably 38 to 76 mm, from the viewpoint of spinnability and processability. In one or more embodiments of the present invention, the fineness of the fibers is measured based on JIS L 1015 (2010).

There is no particular limitation on the strengths of the first modacrylic fibers, the second modacrylic fibers and the other modacrylic fibers, but the strengths thereof may be preferably 1.0 to 4.0 cN/dtex, and more preferably 1.5 to 3.0 cN/dtex, from the viewpoint of spinnability and processability. Also, there is no particular limitation on the elongations of the first modacrylic fibers, the second modacrylic fibers and the other modacrylic fibers, but the elongations thereof may be preferably 20 to 35%, and more preferably 20 to 25%, from the viewpoint of spinnability and processability. In one or more embodiments of the present invention, the strength and elongation of the fibers are measured based on JIS L 1015 (2010).

For example, the first modacrylic fibers can be produced in the same manner as general modacrylic fibers through wet spinning of a spinning solution, except that the infrared absorber and the like are added to a spinning solution that contains a modacrylic polymer dissolved therein.

For example, the second modacrylic fibers can be produced in the same manner as general modacrylic fibers through wet spinning of a spinning solution, except that the heat absorbing material and/or the light reflecting material and the like are added to a spinning solution that contains a modacrylic polymer dissolved therein.

The aramid fibers may be para-aramid fibers or meta-aramid fibers. There is no particular limitation on the fineness of the aramid fibers, but the fineness thereof may be preferably 1 to 20 dtex, and more preferably 1.5 to 15 dtex, from the viewpoint of strength. Also, there is no particular limitation on the fiber length of the aramid fibers, but the fiber length thereof may be preferably 38 to 127 mm, and more preferably 38 to 76 mm, from the viewpoint of strength.

There is no particular limitation on the type of the cellulosic fibers, but natural cellulosic fibers may be preferably used from the viewpoint of durability. Examples of the natural cellulosic fibers include cotton, kabok, linen, ramie, and jute. Also, the natural cellulosic fibers may be flame-retarded cellulosic fibers obtained by subjecting natural cellulose fibers such as cotton, kapok, linen, ramie, or jute, to a flame-retardant treatment using a flame retardant such as a phosphorus-based compound (e.g., N-methylol phosphonate compound, tetrakishydroxyalkylphosphonium salt). The fiber length of the natural cellulosic fibers may be preferably 15 to 38 mm, and more preferably 20 to 38 mm, from the viewpoint of strength. Examples of the regenerated cellulosic fibers include rayon, polynosic, cupra, and lyocell. The fiber length of the regenerated cellulosic fibers may be preferably 15 to 38 mm, and more preferably 20 to 38 mm, from the viewpoint of strength. There is no particular limitation on the fineness of the regenerated cellulosic fibers, but the fineness thereof may be preferably 1 to 20 dtex, and more preferably 1.2 to 15 dtex. These cellulosic fibers may be used individually or in combination of two or more.

In one or more embodiments, the first yarns may be spun yarns or filament yarns. The first yarns may be selected appropriately depending on the intended use. When the first yarns include cellulosic fibers, they can be used as spun yarn. For example, the first yarns can be produced through spinning of a fiber mixture including the first modacrylic fibers by a known spinning method. Examples of the spinning method include, though not particularly limited to, ring spinning, open end spinning, and air jet spinning.

The second yarns may be spun yarns or filament yarns. The second yarns may be selected appropriately depending on the intended use. When the second yarns include cellulosic fibers, they can be used as spun yarn. For example, the second yarns can be produced through spinning of a fiber mixture including the second modacrylic fibers by a known spinning method. Examples of the spinning method include, though not particularly limited to, ring spinning, open end spinning, and air jet spinning.

There is no particular limitation on the thicknesses of the first yarns and the second yarns, but the thicknesses thereof may be English cotton count No. 5 to 40, or English cotton count No. 10 to 30 from the viewpoint of suitability for the fabric for arc-protective garments, for example. The yarn types thereof may be single yarn or double yarn.

In one or more embodiments, the fabric for arc-protective garments may be a woven fabric in which the first yarns and the second yarns are woven together or a knitted fabric in which the first yarns and the second yarns are knitted together. The fabric for arc-protective garments also may be a laminated fabric including a first layer composed of the first yarns and a second layer composed of the second yarns. In the case of the laminated fabric, the first layer may be a woven fabric or a knitted fabric, and the second layer may be a woven fabric or a knitted fabric. There is no particular limitation on the weave of the woven fabric, and three foundation weaves including a plain weave, a twill weave and a sateen weave may be applied, or derivative weave with use of a special loom such as a dobby loom or a Jacquard loom may be applied. Also, there is no particular limitation on the knitting of the knitted fabric, and any of circular knitting, flat knitting, and warp knitting may be applied. The fabric for arc-protective garments may be a grid cloth (woven fabric) obtained by using two or more kinds of warp yarns and two or more kinds of weft yarns. In the case of the grid cloth, the first yarns may be used as the weft and warp yarns, and the second yarns as grid yarns may be used as the weft and warp yarns.

There is no particular limitation on the contents of the first yarns and the second yarns in the fabric for arc-protective garments. For example, the fabric for arc-protective garments may include 50 to 90 wt % of the first yarns and 10 to 50 wt % of the second yarns, or 55 to 85 wt % of the first yarns and 15 to 45 wt % of the second yarns, or 70 to 80 wt % of the first yarns and 10 to 20 wt % of the second yarns with respect to the total weight of the fabric. Alternatively, for example, the fabric for arc-protective garments may include, though not particularly limited to, 55 to 60 wt % of the first yarns and 40 to 45 wt % of the second yarns with respect to the total weight of the fabric.

When the fabric for arc-protective garments is a woven fabric or a knitted fabric, it may be preferred that the exposure amount of the first yarns in a first surface of the fabric for arc-protective garments differs from the exposure amount of the first yarns in a second surface located opposite to the first surface of the fabric for arc-protective garments. In the fabric for arc-protective garments, when the surface of the fabric closer to a wearer of the arc-protective garment is a back surface, and the surface of the fabric farther from a wearer of the arc-protective garment is a front surface, it may be preferred that the exposure amount of the first yarns in the front surface of the fabric is larger than the exposure amount of the first yarns in the back surface of the fabric, from the viewpoint of excellent arc resistance. In one or more embodiments of the present invention, the exposure amount of yarns in a predetermined surface of a fabric can be expressed as a percentage of the number of predetermined yarns appearing on a predetermined surface of a fabric with respect to the total number of yarns.

The fabric for arc-protective garments may be preferably a woven fabric in which the first yarns and the second yarns are woven together from the viewpoint of excellent arc resistance, and more preferably a twill weave from the viewpoint of cloth strength or durability. Moreover, the fabric for arc-protective garments may be preferably a 2/1 twill weave, a 3/1 twill weave, a sateen weave, etc., from the viewpoint of differentiating the exposure amount of the first yarns in the first surface of the fabric from the exposure amount of the first yarns in the second surface located opposite to the first surface of the fabric to increase arc resistance. When the fabric for arc-protective garments is a woven fabric in which the first yarns and the second yarns are woven together, the difference in the exposure amount of the first yarns between the first surface of the fabric and the second surface located opposite to the first surface of the fabric may be preferably 10% or more, more preferably 20% or more, and further preferably 30% or more from the viewpoint of excellent arc resistance. When the fabric for arc-protective garments is a woven fabric in which the first yarns and the second yarns are woven together, the difference in the exposure amount of the first yarns between the first surface of the fabric and the second surface located opposite to the first surface of the fabric may be preferably 90% or less, more preferably 80% or less, and further preferably 70% or less from the viewpoint of excellent arc resistance.

When the fabric for arc-protective garments is a woven fabric, the first yarns may be used either as weft yarns or warp yarns. The second yarns may be used either as weft yarns or warp yarns. There is no particular limitation on the density of warp yarns, but the density thereof may be 30 to 140 yarns/inch (2.54 cm) or 80 to 95 yarns/inch. There is no particular limitation on the density of weft yarns, but the density thereof may be 20 to 100 yarns/inch or 60 to 75 yarns/inch.

Figure 1B:
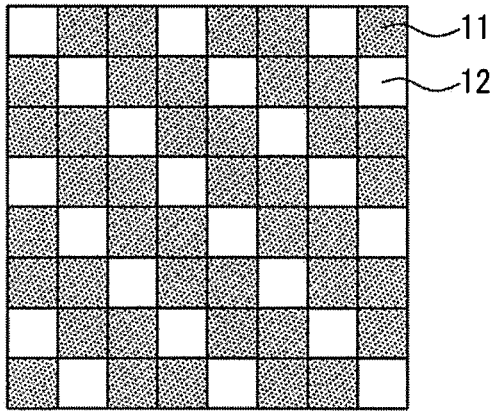
FIG. 1B is a schematic plan view of the front surface of the fabric.
Figure 1C:
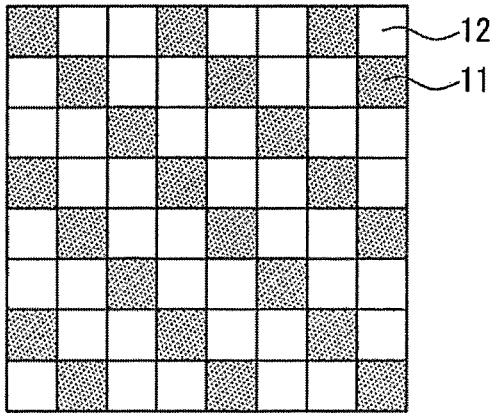
FIG. 1C is a schematic plan view of the back surface of the fabric.

FIG. 1A is a weave diagram of a 2/1 twill weave. As shown in FIG. 1B, which is a schematic structure diagram of the front surface of the 2/1 twill weave, and FIG. 1C, which is a schematic structure diagram of the back surface, warp yarns 11 appear on the front surface at a higher ratio than weft yarns 12 in a woven fabric 10, the ratio being 2:1, whereas weft yarns 12 appear on the back surface at a higher ratio than warp yarns 11, the ratio being 2:1. The percentage (exposure amount) of the warp yarns appearing on the front surface is 67%, whereas the percentage of the warp yarns appearing on the back surface is 33%, with respect to the total number of the warp yarns.

Figure 2A:
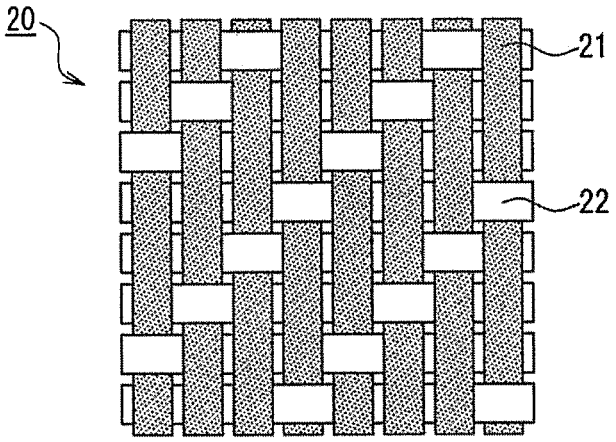
FIG. 2A is a weave diagram of a fabric for arc-protective garments (woven fabric) in one or more embodiments of the present invention.
Figure 2B:
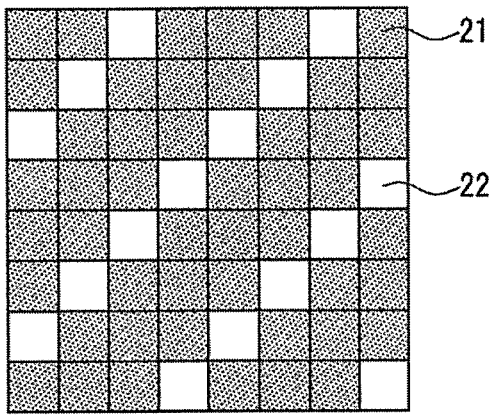
FIG. 2B is a schematic plan view of the front surface of the fabric.
Figure 2C:
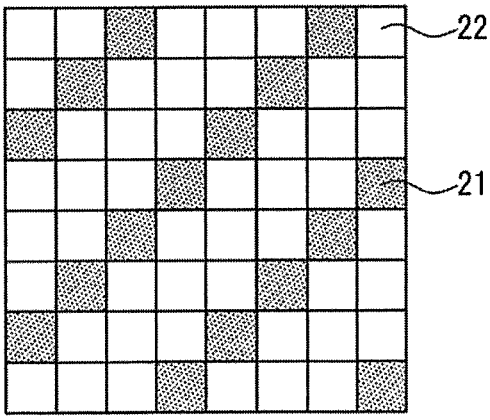
FIG. 2C is a schematic plan view of the back surface of the fabric.

FIG. 2A is a weave diagram of a 3/1 twill weave. As shown in FIG. 2B, which is a schematic structure diagram of the front surface of the 3/1 twill weave, and FIG. 2C, which is a schematic structure diagram of the back surface, warp yarns 21 appear on the front surface at a higher ratio than weft yarns 22 in a woven fabric 20, the ratio being 3:1, whereas weft yarns 22 appear on the back surface at a higher ratio than warp yarns 21, the ratio being 3:1. The percentage (exposure amount) of the warp yarns appearing on the front surface is 75%, whereas the exposure amount of the warp yarns appearing on the back surface is 25%, with respect to the total number of the warp yarns.

In one or more embodiments, the weight of the infrared absorber per unit area in the fabric for arc-protective garments is 0.05 oz/yd$^2$ or more. From the viewpoint of excellent arc resistance, the weight of the infrared absorber per unit area may be preferably 0.06 oz/yd$^2$ or more, more preferably 0.07 oz/yd$^2$ or more, and further preferably 0.08 oz/yd$^2$ or more. The upper limit of the weight of the infrared absorber per unit area in the fabric for arc-protective garments is not particularly limited, but may be 0.26 oz/yd$^2$ or less, from the viewpoint of the increment limit of the infrared absorption effect and cost.

In one or more embodiments, the basis weight (the weight (ounce) of the fabric per unit area (1 square yard)) of the fabric for arc-protective garments is preferably 3 to 10 oz/yd$^2$, more preferably 4 to 9 oz/yd$^2$, and further preferably 4 to 8 oz/yd$^2$. When the basis weight is within the above range, protective garments that are lightweight and have excellent workability can be provided.

In one or more embodiments, the fabric for arc-protective garments may have a specific ATPV (cal/cm$^2$)/(oz/yd$^2$) of preferably more than 1.25, more preferably 1.26 or more, and further preferably 1.3 or more. In one or more embodiments of the present invention, the specific ATPV (cal/cm$^2$)/(oz/yd$^2$) refers to an ATPV (cal/cm$^2$) per unit basis weight (oz/yd$^2$) and is calculated by dividing the ATPV by the basis weight. The ATPV (Arc Thermal Performance Value) is measured through arc testing based on ASTM F1959/F1959M-12 (Standard Test Method for Determining the Arc Rating of Materials for Clothing).

When the fabric for arc-protective garments has a basis weight of 6.5 oz/yd$^2$ or less, the ATPV thereof measured based on ASTM F1959/F1959M-12 (Standard Test Method for Determining the Arc Rating of Materials for Clothing) may be preferably 8 cal/cm$^2$ or more. This makes it possible to provide protective garments that are lightweight and has favorable arc resistance.

There is no particular limitation on the thickness of the fabric for arc-protective garments, but the thickness thereof may be preferably 0.3 to 1.5 mm, more preferably 0.4 to 1.3 mm, and further preferably 0.5 to 1.1 mm, from the viewpoint of strength and comfort of a textile as workwear. The thickness is measured in conformity with JIS L 1096 (2010).

Arc-protective garments of one or more embodiments of the present invention can be manufactured using the fabric for arc-protective garments of one or more embodiments of the present invention by a known method. The arc-protective garments may be single-layer protective garments in which the fabric for arc-protective garments is used in a single layer, or multi-layer protective garments in which the fabric for arc-protective garments is used in two or more layers. In the case of multi-layer protective garments, the fabric for arc-protective garments may be used in all layers or part of layers. When the fabric for arc-protective garments is used in part of layers of the multi-layer protective garments, it may be preferable to use the fabric for arc-protective garments in the outer layer.

In the case of using, as the fabric for arc-protective garments, a fabric in which the exposure amount of the first yarns in the first surface differs from the exposure amount of the first yarns in the second surface located opposite to the first surface, it may be preferable to arrange the surface of the fabric with a higher first yarn exposure amount to the outer side of the arc-protective garment.

The arc-protective garments of one or more embodiments of the present invention have excellent arc resistance as well as favorable flame retardance and workability. Furthermore, even though the arc-protective garments are washed repeatedly, the arc resistance and flame retardance are maintained.

Further, one or more embodiments of the present invention provides a method for using the above fabric as the fabric for arc-protective garments. Specifically, one or more embodiments of the present invention provides a method for using a fabric including first yarns and second yarns for arc-protective garments. The first yarns include first modacrylic fibers, and the first modacrylic fibers contain an infrared absorber in an amount of 2.5% by weight or more inside the fibers with respect to the total weight of the fibers. In the fabric, the weight of the infrared absorber per unit area is 0.05 oz/yd$^2$ or more.

EXAMPLES

Hereinafter, one or more embodiments of the present invention will be described in detail by way of examples. However, the present invention is not limited to the examples. In the following description, "%" and "part" mean "wt %" and "part by weight", respectively, unless otherwise specified.

Modacrylic Fibers of Production Example 1

An acrylic copolymer consisting of 51 wt % of acrylonitrile, 48 wt % of vinylidene chloride, and 1 wt % of sodium p-styrenesulfonate was dissolved in dimethylformamide so that the resin concentration would be 30 wt %. To the obtained resin solution, 10 parts by weight of antimony trioxide ($Sb_2O_3$, product name "Patx-M" manufactured by Nihon Seiko Co., Ltd.) and 5 parts by weight of antimony-doped tin oxide (ATO, product name "SN-100P" manufactured by Ishihara Sangyo Kaisha, Ltd.) with respect to 100 parts by weight of the resin weight were added to prepare a spinning solution. The antimony trioxide was used in the form of a dispersion liquid prepared in advance by adding to dimethylformamide an antimony trioxide in an amount of 30 wt % and dispersing it uniformly. In the dispersion liquid of the antimony trioxide, the particle diameter of the antimony trioxide measured using a laser diffraction method was 2 μm or less. The antimony-doped tin oxide was used in the form of a dispersion liquid prepared in advance by adding to dimethylformamide an antimony-doped tin oxide in an amount of 30 wt % and dispersing it uniformly. In the dispersion liquid of the antimony-doped tin oxide, the particle diameter of the antimony-doped tin oxide measured using a laser diffraction method was 0.01 to 0.03 μm. The obtained spinning solution was extruded into a 50 wt % dimethylformamide aqueous solution using a nozzle with 300 holes having a nozzle hole diameter of 0.08 mm and thus solidified. Thereafter, the solidified product was washed with water and dried at 120° C. After drying, the product was drawn to three times and then further subjected to heat treatment at 145° C. for 5 minutes, whereby modacrylic fibers were obtained. The obtained modacrylic fibers of Production Example 1 had a fineness of 1.7 dtex, a strength of 2.5 cN/dtex, an elongation of 26%, and a cut length of 51 mm. The finenesses, strengths, and elongations of modacrylic fibers of the examples and comparative examples were measured based on JIS L 1015 (2010). The modacrylic fibers of Production Example 1 contained the antimony-doped tin oxide and antimony trioxide inside the fibers. The content of the antimony-doped tin oxide was 4.3 wt %, and the content of the antimony trioxide was 8.7 wt %, with respect to the total weight of the fibers.

Modacrylic Fibers of Production Example 2

Modacrylic fibers of Production Example 2 was obtained in the same manner as in Production Example 1, except that a spinning solution was prepared by adding, to the obtained resin solution, 10 parts by weight of antimony trioxide ($Sb_2O_3$, product name "Patx-M" manufactured by Nihon Seiko Co., Ltd.) and 10 parts by weight of titanium oxide (product name "R-22L" manufactured by Sakai Chemical Industry Co., Ltd.) with respect to 100 parts by weight of the resin weight. The titanium oxide was used in the form of a dispersion liquid prepared in advance by adding to dimethylformamide a titanium oxide in an amount of 30 wt % and dispersing it uniformly. In the dispersion liquid of the titanium oxide, the average particle diameter of the titanium oxide measured using a laser diffraction method was 0.4 pm. The obtained modacrylic fibers of Production Example 2 had a fineness of 1.75 dtex, a strength of 1.66 cN/dtex, an elongation of 22.9%, and a cut length of 51 mm. The modacrylic fibers of Production Example 2 contained the titanium oxide and antimony trioxide inside the fibers. The content of the titanium oxide was 8.3 wt %, and the content of the antimony trioxide was 8.3 wt %, with respect to the total weight of the fibers.

Modacrylic Fibers of Production Example 3

Modacrylic fibers of Production Example 3 was obtained in the same manner as in Production Example 1, except that a spinning solution was prepared by adding, to the obtained resin solution, 10 parts by weight of antimony trioxide ($Sb_2O_3$, product name "Patx-M" manufactured by Nihon Seiko Co., Ltd.) and 5 parts by weight of aluminium hydroxide (product name "C-301N" manufactured by Sumitomo Chemical Co., Ltd.) with respect to 100 parts by weight of the resin weight. The aluminium hydroxide was used in the form of a dispersion liquid prepared in advance by adding to dimethylformamide an aluminium hydroxide in an amount of 30 wt % and dispersing it uniformly. In the dispersion liquid of the aluminium hydroxide, the average particle diameter of the aluminium hydroxide measured using a laser diffraction method was 2 μm. The obtained modacrylic fibers of Production Example 3 had a fineness of 1.81 dtex, a strength of 2.54 cN/dtex, an elongation of 27.5%, and a cut length of 51 mm. The modacrylic fibers of Production Example 3 contained the aluminium hydroxide and antimony trioxide inside the fibers. The content of the aluminium hydroxide was 4.3 wt %, and the content of the antimony trioxide was 8.7 wt %, with respect to the total weight of the fibers.

Modacrylic Fibers of Production Example 4

Modacrylic fibers of Production Example 4 was obtained in the same manner as in Production Example 1, except that a spinning solution was prepared by adding, to the obtained resin solution, 26 parts by weight of antimony trioxide ($Sb_2O_3$, product name "Patx-M" manufactured by Nihon Seiko Co., Ltd.) with respect to 100 parts by weight of the resin weight. The obtained modacrylic fibers of Production Example 4 had a fineness of 2.2 dtex, a strength of 2.33 cN/dtex, an elongation of 22.3%, and a cut length of 51 mm. The modacrylic fibers of Production Example 4 contained 20.6 wt % of the antimony trioxide with respect to the total weight of the fibers.

Modacrylic Fibers of Production Example 5

Modacrylic fibers of Production Example 5 was obtained in the same manner as in Production Example 1, except that a spinning solution was prepared by adding, to the obtained resin solution, 10 parts by weight of antimony trioxide ($Sb_2O_3$, product name "Patx-M" manufactured by Nihon Seiko Co., Ltd.) with respect to 100 parts by weight of the resin weight. The obtained modacrylic fibers of Production Example 5 had a fineness of 1.7 dtex, a strength of 3.4 cN/dtex, an elongation of 34%, and a cut length of 51 mm. The modacrylic fibers of Production Example 5 contained 9.1 wt % of the antimony trioxide with respect to the total weight of the fibers.

Modacrylic Fibers of Production Example 6

Modacrylic fibers of Production Example 6 was obtained in the same manner as in Production Example 1, except that a resin solution was prepared by dissolving, in dimethylformamide, an acrylic copolymer consisting of 49 wt % of acrylonitrile, 50.5 wt % of vinyl chloride, and 0.5 wt % of sodium p-styrenesulfonate so that the resin concentration would be 30 wt %, and that a spinning solution was prepared by adding, to the obtained resin solution, 6 parts by weight of antimony trioxide ($Sb_2O_3$, product name "Patx-M" manufactured by Nihon Seiko Co., Ltd.) with respect to 100 parts by weight of the resin weight. The obtained modacrylic fibers of Production Example 6 had a fineness of 1.9 dtex, a strength of 2.7 cN/dtex, an elongation of 29%, and a cut length of 51 mm. The modacrylic fibers of Production Example 6 contained 5.7 wt % of the antimony trioxide with respect to the total weight of the fibers.

Modacrylic Fibers of Production Example 7

Modacrylic fibers of Production Example 7 was obtained in the same manner as in Production Example 1, except that a spinning solution was prepared by adding, to the obtained resin solution, 10 parts by weight of antimony trioxide ($Sb_2O_3$, product name "Patx-M" manufactured by Nihon Seiko Co., Ltd.) and 3 parts by weight of antimony-doped tin oxide (ATO, product name "SN-100P" manufactured by Ishihara Sangyo Kaisha, Ltd.) with respect to 100 parts by weight of the resin weight. The obtained modacrylic fibers of Production Example 7 had a fineness of 1.7 dtex, a strength of 2.5 cN/dtex, an elongation of 27%, and a cut length of 51 mm. The modacrylic fibers of Production Example 7 contained the antimony-doped tin oxide and antimony trioxide inside the fibers. The content of the antimony-doped tin oxide was 2.6 wt %, and the content of the antimony trioxide was 8.8 wt %, with respect to the total weight of the fibers.

Modacrylic Fibers of Production Example 8

Modacrylic fibers of Production Example 8 was obtained in the same manner as in Production Example 1, except that a resin solution was prepared by dissolving, in dimethylformamide, an acrylic copolymer consisting of 49 wt % of acrylonitrile, 50.5 wt % of vinyl chloride, and 0.5 wt % of sodium p-styrenesulfonate so that the resin concentration would be 30 wt %, and that a spinning solution was prepared by adding, to the obtained resin solution, 10 parts by weight of antimony trioxide ($Sb_2O_3$, product name "Patx-M" manufactured by Nihon Seiko Co., Ltd.) with respect to 100 parts by weight of the resin weight. The obtained modacrylic fibers of Production Example 8 had a fineness of 1.7 dtex, a strength of 2.8 cN/dtex, an elongation of 29%, and a cut length of 51 mm. The modacrylic fibers of Production Example 8 contained 9.1 wt % of the antimony trioxide with respect to the total weight of the fibers.

Spun Yarns of Production Examples 1-10

The modacrylic fibers obtained in Production Examples 1-8, para-aramid fibers (product name "Taparan (registered trademark)" manufactured by Yantai Tayho Advanced Materials Co., Ltd., having a fineness of 1.67 dtex and a fiber length of 51 mm, hereinafter also referred to as "PA") and cellulosic fibers (lyocell fibers, "Tencel (registered trademark)" manufactured by Lenzing, having a fineness of 1.4 dtex and a fiber length of 38 mm, hereinafter also referred to as "Tencel") were mixed in ratios shown in Table 1 below, and then were spun through ring spinning. The spun yarns obtained in Production Examples 1-7 were mixed yarns of English cotton count No. 20 (single yarns), the spun yarns obtained in Production Examples 8-9 were mixed yarns of English cotton count No. 38 (double yarns), and the spun yarns obtained in Production Example 10 were mixed yarns of English cotton count No. 35 (double yarns).

TABLE 1

| | Blending ratio (wt %) | | | | | | | | | |
|---|---|---|---|---|---|---|---|---|---|---|
| | Production Examples of modacrylic fibers | | | | | | | | | |
| Spun yarns | 1 | 2 | 3 | 4 | 5 | 6 | 7 | 8 | PA | Tencel |
| Prod. Ex. 1 | 48 | — | — | — | — | — | — | — | 15 | 37 |
| Prod. Ex. 2 | — | 48 | — | — | — | — | — | — | 15 | 37 |
| Prod. Ex. 3 | — | — | 48 | — | — | — | — | — | 15 | 37 |
| Prod. Ex. 4 | — | — | — | 48 | — | — | — | — | 15 | 37 |
| Prod. Ex. 5 | — | — | — | — | 48 | — | — | — | 15 | 37 |
| Prod. Ex. 6 | — | — | — | — | — | 48 | — | — | 15 | 37 |
| Prod. Ex. 7 | — | — | — | — | — | — | 48 | — | 15 | 37 |
| Prod. Ex. 8 | 48 | — | — | — | — | — | — | 36 | 16 | — |
| Prod. Ex. 9 | — | — | — | — | 48 | — | — | 36 | 16 | — |
| Prod. Ex. 10 | — | — | — | — | — | — | — | — | 14 | 86 |

* Prod. Ex.: Production Example

Table 2 below show the standard moisture regains (the values indicated in JIS

L 0105, 4.1, Table 1) of the modacrylic fibers obtained in Production Examples 1-8, para-aramid fibers (PA), and cellulosic fibers (Tencel).

TABLE 2

| Fibers | Type of fibers indicated in JIS L 0105, 4.1, Table 1 | Standard moisture regain (%) |
|---|---|---|
| Modacrylic fibers | Modacrylic fibers | 2.0 |
| Para-aramid fibers (PA) | Aramid fibers | 7.0 |
| Cellulosic fibers (Tencel) | Lyocell | 11.0 |

Example 1

A woven fabric (thickness: 0.45 mm) of Example 1 having a 2/1 twill structure as shown in FIG. 1 was produced using the spun yarns of Production Example 5 as warp yarns and the spun yarns of Production Example 1 as weft yarns. The density of the warp yarns was 90 yarns/inch, and the density of the weft yarns was 70 yarns/inch. The basis weight was 6.5 oz/yd$^2$. In Example 1, the weft yarns were the first yarns, and the warp yarns were the second yarns. In the woven fabric of Example 1, the content of the first yarns was 44 wt %, and the content of the second yarns was 56 wt %, with respect to the total weight of the woven fabric.

Example 2

A woven fabric (thickness: 0.45 mm) of Example 2 having a 3/1 twill structure as shown in FIG. 2 was produced using the spun yarns of Production Example 1 as warp yarns and the spun yarns of Production Example 2 as weft yarns. The density of the warp yarns was 80 yarns/inch, and the density of the weft yarns was 60 yarns/inch. The basis weight was 5.3 oz/yd$^2$. In Example 2, the warp yarns were the first yarns, and the weft yarns were the second yarns. In the woven fabric of Example 2, the content of the first yarns was 57 wt %, and the content of the second yarns was 43 wt %, with respect to the total weight of the woven fabric.

Example 3

A woven fabric (thickness: 0.45 mm) of Example 3 having a 3/1 twill structure as shown in FIG. 2 was produced using the spun yarns of Production Example 1 as warp yarns and the spun yarns of Production Example 3 as weft yarns. The density of the warp yarns was 80 yarns/inch, and the density of the weft yarns was 60 yarns/inch. The basis weight was 5.1 oz/yd$^2$. In Example 3, the warp yarns were the first yarns, and the weft yarns were the second yarns. In the woven fabric of Example 3, the content of the first yarns was 57 wt %, and the content of the second yarns was 43 wt %, with respect to the total weight of the woven fabric.

Example 4

A woven fabric (thickness: 0.45 mm) of Example 4 having a 3/1 twill structure as shown in FIG. 2 was produced using the spun yarns of Production Example 1 as warp yarns and the spun yarns of Production Example 4 as weft yarns. The density of the warp yarns was 80 yarns/inch, and the density of the weft yarns was 60 yarns/inch. The basis weight was 5.2 oz/yd$^2$. In Example 4, the warp yarns were the first yarns, and the weft yarns were the second yarns. In the woven fabric of Example 4, the content of the first yarns was 57 wt %, and the content of the second yarns was 43 wt %, with respect to the total weight of the woven fabric.

Example 5

A woven fabric (thickness: 0.45 mm) of Example 5 having a $^2/_1$ twill structure was produced using the spun yarns of Production Examples 1 and 6 as warp yarns and the spun yarns of Production Examples 1 and 6 as weft yarns. The density of the warp yarns was 80 yarns/inch, and the density of the weft yarns was 60 yarns/inch. The basis weight was 5.3 oz/yd$^2$. The woven fabric of Example 5 was a grid cloth in which the spun yarns of Production Examples 6 were used as grid yarns, wherein the grid yarn density was 3 yarns/18 yarns in the warp yarns and 3 yarns/15 yarns in the weft yarns. Specifically, the spun yarns of Production Example 1 and the spun yarns of Production Examples 6 were used as the warp yarns, and 15 spun yarns of Production Example 1 and 3 spun yarns of Production Example 6 were woven in this order. The spun yarns of Production Example 1 and the spun yarns of Production Examples 6 were used as the weft yarns, and 12 spun yarns of Production Example 1 and 3 spun yarns of Production Example 6 were woven in this order. In Example 5, the spun yarns of Production Example 1 were the first yarns, and the spun yarns of Production Example 6 were the second yarns. In the woven fabric of Example 5, the content of the first yarns was 82 wt %, and the content of the second yarns was 18 wt %, with respect to the total weight of the woven fabric.

Example 6

A woven fabric (thickness: 0.45 mm) of Example 6 having a 2/1 twill structure as shown in FIG. 1 was produced using the spun yarns of Production Example 8 as warp yarns and the spun yarns of Production Example 10 as weft yarns. The density of the warp yarns was 78 yarns/inch, and the density of the weft yarns was 58 yarns/inch. The basis weight was 5.7 oz/yd$^2$. In Example 6, the warp yarns were the first yarns, and the weft yarns were the second yarns. In the woven fabric of Example 6, the content of the first yarns was 57 wt %, and the content of the second yarns was 43 wt %, with respect to the total weight of the woven fabric.

Comparative Example 1

A woven fabric (thickness: 0.45 mm) of Comparative Example 1 having a 2/1 twill structure was produced using the spun yarns of Production Example 5 as warp and weft yarns. The density of the warp yarns was 90 yarns/inch, and the density of the weft yarns was 70 yarns/inch. The basis weight was 6.2 oz/yd$^2$.

Comparative Example 2

A woven fabric (thickness: 0.45 mm) of Comparative Example 2 having a 3/1 twill structure as shown in FIG. 2 was produced using the spun yarns of Production Example 5 as warp yarns and the spun yarns of Production Example 7 as weft yarns. The density of the warp yarns was 80 yarns/inch, and the density of the weft yarns was 60 yarns/inch. The basis weight was 5.2 oz/yd$^2$. In Comparative Example 2, the weft yarns were the first yarns, and the warp yarns were the second yarns. In the woven fabric of Comparative Example 2, the content of the first yarns was 43 wt %, and the content of the second yarns was 57 wt %, with respect to the total weight of the woven fabric.

Comparative Example 3

A woven fabric (thickness: 0.45 mm) of Comparative Example 3 having a 2/1 twill structure as shown in FIG. 1 was produced using the spun yarns of Production Example 9 as warp yarns and the spun yarns of Production Example 10 as weft yarns. The density of the warp yarns was 84 yarns/inch, and the density of the weft yarns was 63 yarns/inch. The basis weight was 6.2 oz/yd$^2$.

Reference Example 1

A woven fabric (thickness: 0.45 mm) of Reference Example 1 having a 2/1 twill structure was produced using the spun yarns of Production Example 1 as warp and weft yarns. The density of the warp yarns was 90 yarns/inch, and the density of the weft yarns was 70 yarns/inch. The basis weight was 6.4 oz/yd$^2$.

The arc resistances of the fabrics of Examples 1-6, Comparative Examples 1-3, and Reference Example 1 were evaluated by arc testing in the manner described below. Table 3 below shows the results. Table 3 also shows the exposure amounts of the first yarns in the front and back surfaces of the fabrics, and the basis weights of the fabrics.

Arc Testing

The arc testing was performed based on ASTM F1959/F1959M-12 (Standard Test Method for Determining the Arc Rating of Materials for Clothing) to determine an ATPV (cal/cm$^2$) of the fabric.

Specific ATPV

An ATPV per unit basis weight (cal/cm$^2$)/(oz/yd$^2$) of the fabric, i.e., a specific ATPV, was calculated based on the basis weight of the fabric and the ATPV determined by the arc testing.

TABLE 3

| | | | Exposure amount of first yarns (%) | | | Yarn density (the number of yarns/inch) | | Basis | Content of infrared absorber per | | | Specific ATPV |
|---|---|---|---|---|---|---|---|---|---|---|---|---|
| | Warp Yarns | Weft yarns | First surface | Second surface | Weave structure | Warp yarns | Weft yarns | weight (oz/yd$^2$) | unit area in fabric (oz/yd$^2$) | Irradiated surface | ATPV (cal/cm$^2$) | ((cal/cm$^2$)/(oz/yd$^2$)) |
| Ex. 1 | Prod. Ex. 5 | Prod. Ex. 1 | 66.7 | 33.3 | 2/1 | 90 | 70 | 6.5 | 0.0587 | Second surface | 8.4 | 1.29 |
| Ex. 2 | Prod. Ex. 1 | Prod. Ex. 2 | 75 | 25 | 3/1 | 80 | 60 | 5.3 | 0.0625 | First surface | 9.0 | 1.70 |
| | | | | | | | | | | Second surface | 8.5 | 1.60 |
| Ex. 3 | Prod. Ex. 1 | Prod. Ex. 3 | 75 | 25 | 3/1 | 80 | 60 | 5.1 | 0.0602 | First surface | 7.2 | 1.41 |
| Ex. 4 | Prod. Ex. 1 | Prod. Ex. 4 | 75 | 25 | 3/1 | 80 | 60 | 5.2 | 0.0613 | First surface | 8.2 | 1.58 |
| | | | | | | | | | | Second surface | 8.0 | 1.54 |
| Ex. 5 | Prod. Ex. 1/ Prod. Ex. 6 | Prod. Ex. 1/ Prod. Ex. 6 | 82.2 | 81.1 | 2/1 | 80 | 60 | 5.3 | 0.0896 | First surface | 9.0 | 1.70 |
| Ex. 6 | Prod. Ex. 8 | Prod. Ex. 10 | 66.7 | 33.3 | 2/1 | 78 | 58 | 5.7 | 0.0683 | First surface | 8.6 | 1.51 |
| Comp. Ex. 1 | Prod. Ex. 5 | Prod. Ex. 5 | 0 | 0 | 2/1 | 90 | 70 | 6.2 | 0 | First surface | 7.1 | 1.15 |
| Comp. Ex. 2 | Prod. Ex. 5 | Prod. Ex. 7 | 75 | 25 | 3/1 | 80 | 60 | 5.2 | 0.0283 | First surface | 6.5 | 1.25 |
| Comp. Ex. 3 | Prod. Ex. 9 | Prod. Ex. 10 | 0 | 0 | 2/1 | 84 | 63 | 6.2 | 0 | First surface | 7.6 | 1.23 |

TABLE 3-continued

| | Warp Yarns | Weft yarns | Exposure amount of first yarns (%) First surface | Exposure amount of first yarns (%) Second surface | Weave structure | Yarn density (the number of yarns/inch) Warp yarns | Yarn density (the number of yarns/inch) Weft yarns | Basis weight (oz/yd$^2$) | Content of infrared absorber per unit area in fabric (oz/yd$^2$) | Irradiated surface | ATPV (cal/cm$^2$) | Specific ATPV ((cal/cm$^2$)/(oz/yd$^2$)) |
|---|---|---|---|---|---|---|---|---|---|---|---|---|
| Ref. Ex. 1 | Prod. Ex. 1 | Prod. Ex. 1 | 100 | 100 | 2/1 | 90 | 70 | 6.4 | 0.1321 | First surface | 7.7 | 1.20 |

* Ex.: Example,
Comp. Ex.: Comparative Example,
Ref. Ex.: Reference Example,
Prod. Ex.: Production Example As can be seen from data of Table 3 above, the woven fabrics of Examples 1-6, which were produced using the first yarns that include the first modacrylic fibers containing an infrared absorber in an amount of 2.5% by weight or more inside the fibers with respect to the total weight of the fibers and second yarns that are different from the first yarns, wherein the weight of the infrared absorber per unit area of the fabrics is 0.05 oz/yd$^2$ or more, exhibited higher arc resistance and had a higher specific ATPV of over 1.25 (cal/cm$^2$)/(oz/yd$^2$) than the woven fabric of Comparative Example 1, which was produced using, in both of the warp yarns and the weft yarns, the yarns that include the modacrylic fibers not containing an infrared absorber, the woven fabric of Comparative Example 2, in which the weft yarns include the modacrylic fibers containing an infrared absorber but the weight of the infrared absorber per unit area in the fabric is less than 0.05 oz/yd$^2$, and the woven fabric of Comparative Example 3, in which neither the warp yarns nor the weft yarns include the modacrylic fibers containing an infrared absorber, and the woven fabric of Reference Example 1, which was produced using, in both of the warp yarns and the weft yarns, the first yarns that include the first modacrylic fibers containing an infrared absorber. Moreover, the woven fabrics of examples had an ATPV of 8 cal/cm$^2$ or more even when the basis weight was 6.5 oz/yd$^2$ or less, and exhibited excellent arc resistance.

It was found from the comparison between Examples 2 and 4 that the fabric produced using the modacrylic fibers containing an infrared absorber in the first yarns and the modacrylic fibers containing a light reflecting material in the second yarns tend to have a higher ATPV. It also was found from the comparison between Examples 1 and 6 that the fabric produced using the modacrylic fibers containing an infrared absorber in the first yarns and the high-moisture fibers in the second yarns tend to have a higher ATPV. Moreover, it was found from data of Examples 2 and 4 that the use of the surface with a higher first yarn exposure amount as the irradiation surface provides a higher ATPV. The reason for this is considered to be that heat converted from infrared rays that have been absorbed by the infrared absorber in the first yarns is less likely to be conducted to the back surface when the surface with a higher first yarn exposure amount is used as the irradiation surface, whereby arc resistance is improved.

LIST OF REFERENCE NUMERALS

10, 20 Woven fabrics
11, 21 Warp yarns
12, 22 Weft yarns Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A fabric for woven or knitted arc-protective garments, comprising first yarns and second yarns, wherein
- the first yarns comprise one or more fibers,
- the second yarns comprise one or more fibers,
- the first yarns are different from the second yarns,
- the first yarns comprise first modacrylic fibers,
- the first modacrylic fibers comprise a modacrylic polymer containing 40% to 70% by weight of acrylonitrile, 30% to 57% by weight of a halogen-containing vinyl-based monomer, and 0% to 3% by weight of a sulfonic acid group-containing monomer,
- the first modacrylic fibers comprise an infrared absorber in an amount of 2.5% by weight or more with respect to a total weight of the first modacrylic fibers,
- the infrared absorber is one or more selected from the group consisting of tin oxide-based compounds, titanium oxide-based compounds, and zinc oxide-based compounds,
- the second yarns do not comprise the first modacrylic fibers, or the second yarns contain the first modacrylic fibers in a lower amount than the first yarns,
- the fabric for arc-protective garments comprises the infrared absorber in a weight per unit area of 0.05 oz/yd$^2$ or more,
- the fabric for arc-protective garments are woven or knitted,
- wherein the tin oxide-based compounds, the titanium oxide-based compounds, and the zinc oxide-based compounds are at least one selected from the group consisting of antimony-doped tin oxide, indium tin oxide, niobium-doped tin oxide, phosphorus-doped tin oxide, fluorine-doped tin oxide, antimony-doped tin oxide coating on titanium oxide, iron-doped titanium oxide, carbon-doped titanium oxide, fluorine-doped titanium oxide, nitrogen-doped titanium oxide, aluminum-doped zinc oxide, and antimony-doped zinc oxide.

2. The fabric for arc-protective garments according to claim 1, wherein an exposure amount of the first yarns in a first surface of the fabric for arc-protective garments differs from an exposure amount of the first yarns in a second surface of the fabric for arc-protective garments, wherein the second surface is located opposite to the first surface.

3. The fabric for arc-protective garments according to claim 1, wherein the first yarns comprise the first modacrylic fibers in an amount of 30% by weight or more with respect to a total weight of the first yarns.

4. The fabric for arc-protective garments according to claim 1, wherein the first modacrylic fibers further comprise an antimony compound.

5. The fabric for arc-protective garments according to claim 1, wherein the second yarns comprise modacrylic fibers and/or fibers having a standard moisture regain of 8% or more.

6. The fabric for arc-protective garments according to claim 1, wherein the second yarns comprise second modacrylic fibers containing a heat absorbing material and/or a light reflecting material.

7. The fabric for arc-protective garments according to claim 6, wherein the heat absorbing material is an aluminium hydroxide.

8. The fabric for arc-protective garments according to claim 6, wherein the light reflecting material is a titanium oxide.

9. The fabric for arc-protective garments according to claim 1, wherein when the fabric for arc-protective garments has a basis weight of 6.5 oz/yd2 or less, an Arc Thermal Performance Value (ATPV) of the fabric for arc-protective garments as measured according to ASTM F1959/F1959M-12 (Standard Test Method for Determining the Arc Rating of Materials for Clothing) is 8 cal/cm$^2$ or more.

10. An arc-protective garment comprising the fabric for arc-protective garments according to claim 1.

11. The fabric for arc-protective garments according to claim 1, wherein the fabric for arc-protective garments is a woven fabric in which the first yarns and the second yarns are woven together.

12. The fabric for arc-protective garments according to claim 11, wherein an exposure amount of the first yarns in a first surface of the fabric for arc-protective garments differs from an exposure amount of the first yarns in a second surface of the fabric for arc-protective garments, wherein the second surface is located opposite to the first surface.

13. The fabric for arc-protective garments according to claim 11, wherein the first yarns comprise the first modacrylic fibers in an amount of 30% by weight or more with respect to a total weight of the first yarns.

14. The fabric for arc-protective garments according to claim 11, wherein the first modacrylic fibers further comprise an antimony compound.

15. The fabric for arc-protective garments according to claim 11, wherein the second yarns comprise modacrylic fibers and/or fibers having a standard moisture regain of 8% or more.

16. The fabric for arc-protective garments according to claim 11, wherein the second yarns comprise second modacrylic fibers containing a heat absorbing material and/or a light reflecting material.

17. The fabric for arc-protective garments according to claim 16, wherein the heat absorbing material is an aluminium hydroxide.

18. The fabric for arc-protective garments according to claim 16, wherein the light reflecting material is a titanium oxide.

19. The fabric for arc-protective garments according to claim 11, wherein when the fabric for arc-protective garments has a basis weight of 6.5 oz/yd2 or less, an Arc Thermal Performance Value (ATPV) of the fabric for arc-protective garments as measured according to ASTM F1959/F1959M-12 (Standard Test Method for Determining the Arc Rating of Materials for Clothing) is 8 cal/cm$^2$ or more.

* * * * *